US005474373A

United States Patent [19]

Forester

[11] Patent Number: 5,474,373

[45] Date of Patent: Dec. 12, 1995

[54] COMPUTER DESK

[76] Inventor: John M. Forester, 1600 B. Pantelleria, Clovis, N.M. 88101-8118

[21] Appl. No.: 298,308

[22] Filed: Sep. 1, 1994

[51] Int. Cl.[6] ..... A47B 17/00

[52] U.S. Cl. ..... 312/196; 312/208.1

[58] Field of Search ..... 312/196, 194, 312/208.1, 223.3

[56] References Cited

U.S. PATENT DOCUMENTS

| | | | |
|---|---|---|---|
| 98,038 | 12/1869 | Cotter | 312/196 |
| D. 271,260 | 11/1983 | Turner . | |
| 464,521 | 12/1891 | Posz | 312/196 X |
| 1,430,465 | 9/1922 | Neimuth | 312/196 X |
| 4,925,240 | 5/1990 | Peters . | |
| 5,242,217 | 9/1993 | Gonnet . | |
| 5,410,972 | 5/1995 | Schairbaum | 312/223.3 X |
| 5,416,666 | 5/1995 | Maguire | 312/223.3 X |

*Primary Examiner*—Jose V. Chen
*Assistant Examiner*—Gerald A. Anderson

[57] ABSTRACT

A computer desk comprising a generally horizontal table top; a plurality of spaced legs extended downwards from the table top for contacting a recipient surface therebelow and thereby creating a plurality of lower holding spaces; a generally horizontal keyboard shelf extendably secured below the table top; a plurality of stacked drawers disposed within at least one lower holding space and slidably coupled between the adjacent legs with some of the drawers having a plurality of dividers arranged in sequence therein thereby creating a plurality of computer disk holding spaces; a rigid frame having a generally horizontal top wall offset above the table top and a pair of opposed spaced side walls each extended downwards and outwards at an angle from the top wall and coupled with the table top and thereby creating an upper holding space; and a plurality of shelves secured within the upper holding space and thereby creating a plurality of storage compartments.

6 Claims, 4 Drawing Sheets

COMPUTER DESK

BACKGROUND OF THE INVENTION

1. Field of the Invention

The present invention relates to a computer desk and more particularly pertains to supporting computer-related equipment and holding computer storage disks with a computer desk.

2. Description of the Prior Art

The use of computer desks is known in the prior art. More specifically, computer desks heretofore devised and utilized for the purpose of supporting a computer are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 271,260 to Turner discloses a computer desk. U.S. Pat. Des. No. 278,108 to Lyman et al. discloses a modular computer desk. U.S. Pat. No. 4,836,623 to Holland discloses an executive desk convertible into a computer center. U.S. Pat. No. 4,925,240 to Peters discloses a personal computer desk. U.S. Pat. No. 5,242,217 to Gonnet discloses a desk with computer work station.

While these devices fulfill their respective, particular objective and requirements, the aforementioned patents do not describe a computer desk that provides an extended working surface for using a computer and associated peripheral devices thereon while simultaneously allowing for the storage of computer disks therein for ready access when needed.

In this respect, the computer desk according to the present invention substantially departs from the conventional concepts and designs of the prior art, and in doing so provides an apparatus primarily developed for the purpose of supporting computer-related equipment and holding computer storage disks therein.

Therefore, it can be appreciated that there exists a continuing need for new and improved computer desk which can be used for supporting computer-related equipment and holding computer storage disks therein. In this regard, the present invention substantially fulfills this need.

SUMMARY OF THE INVENTION

In the view of the foregoing disadvantages inherent in the known types of computer desks now present in the prior art, the present invention provides an improved computer desk. As such, the general purpose of the present invention, which will be described subsequently in greater detail, is to provide a new and improved computer desk and method which has all the advantages of the prior art and none of the disadvantages.

To attain this, the present invention essentially comprises, in combination, a horizontal rectangular rigid planar table top having a top surface and a bottom surface and a periphery interconnecting the top surface with the bottom surface having a front edge, rear edge, and opposed side edges extended therebetween. Two parallel spaced vertical rectangular rigid planar outer legs are included with each outer leg coupled to a separate side edge of the table top and extended downwards therefrom for contacting a recipient surface. Two parallel spaced vertical rectangular rigid planar inner legs are included with the inner legs coupled to the bottom surface of the table top at locations inwardly offset towards the center of the table top. The inner legs are extended downwards therefrom for contacting a recipient surface and thereby creating an inner holding space located between the inner legs and a pair of outer holding spaces each located between an inner leg and an outer leg. A vertical rectangular rigid planar lower back wall is included and secured to the rear edge of the table top and vertical edges of the legs therebelow. A horizontal rectangular rigid planar keyboard shelf is included and slidably coupled between the inner legs at a location offset below the table top. A horizontal rigid beam is included and coupled between the inner legs at a location offset below the keyboard shelf and adjacent to the lower back wall. A vertical rectangular rigid planar intermediate leg is included and disposed within one of the outer holding spaces at a location between an inner leg and an outer leg, coupled to the bottom surface of the table top, and extended downwards therefrom for contacting a recipient surface and thereby creating an inner drawer space and an outer drawer space. A plurality of stacked disk drawers are included and disposed within the inner drawer space and slidably coupled between the inner leg and intermediate leg. Each disk drawer has a plurality of longitudinally positioned vertical rigid spacers disposed therein creating an array of channels and a plurality of adjustable vertical rigid dividers arranged in sequence within the channels and thereby creating a plurality of computer disk holding spaces. Each divider further includes a notch formed thereon for allowing easy access within a computer disk holding space. A plurality of stacked storage drawers are included and disposed within the outer drawer space and slidably coupled between the outer leg and intermediate leg.

A rigid frame is included and has a horizontal rectangular rigid planar top wall centrally offset above the table top and a pair of rectangular planar side walls coupled to opposite edges of the top wall and each extended downwards and outwards at an angle and coupled with a separate side edge of the table top thereby creating an upper holding space. A rigid lower shelf is included and disposed within the upper holding space above the table top. The lower shelf has a horizontal rectangular planar top secured between the side walls of the frame and four vertical spaced rectangular legs extended downwards therefrom and coupled to the upper surface of the table top thereby creating five lower storage compartments. A rigid upper inner shelf is included and disposed within the upper holding space above the lower shelf. The upper inner shelf has a horizontal rectangular planar top coupled between the side walls of the frame and two vertical spaced rectangular inner legs coupled between the side walls of the frame and the top of the lower shelf thereby creating a central upper storage compartment and a central intermediate storage compartment. A pair of rigid upper outer shelves are included and disposed within the upper holding space on opposite sides of the central intermediate storage compartment. Each upper outer shelf having a horizontal rectangular planar top coupled between a side wall of the frame and an inner leg of the upper inner shelf and a vertical outer leg coupled to a side wall of the frame and the top of the lower shelf. Each upper outer shelf thus creates an outer intermediate storage compartment, an inner intermediate storage compartment, and an upper intermediate storage compartment. A pair of doors is included with each door extended over a separate inner intermediate storage compartment and hingeably secured to an inner leg of the upper inner shelf and an outer leg of the upper outer shelf. A horizontal rectangular rigid slide-out top is included and coupled to the bottom surface of the table top above the disk drawers. Lastly, a vertical trapezoidal planar rigid upper back wall is included and coupled across the side walls and top wall of the frame and planarly aligned with the lower back wall.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved computer desk which has all the advantages of the prior art computer desks and none of the disadvantages.

It is another object of the present invention to provide a new and improved computer desk which may be easily and efficiently manufactured and marketed.

It is a further object of the present invention to provide a new and improved computer desk which is of durable and reliable construction.

An even further object of the present invention is to provide a new and improved computer desk which is susceptible of a low cost of manufacture with regard to both materials and labor, and which accordingly is then susceptible of low prices of sale to the consuming public, thereby making such a computer desk economically available to the buying public.

Still yet another object of the present invention is to provide a new and improved computer desk which provides in the apparatuses and methods of the prior art some of the advantages thereof, while simultaneously overcoming some of the disadvantages normally associated therewith.

Even still another object of the present invention is to provide a new and improved computer desk for supporting computer-related equipment and holding computer storage disks therein.

Lastly, it is an object of the present invention to provide a new and improved computer desk comprising a generally horizontal table top; a plurality of spaced legs extended downwards from the table top for contacting a recipient surface therebelow and thereby creating a plurality of lower holding spaces; a generally horizontal keyboard shelf extendably secured below the table top; a plurality of stacked drawers disposed within at least one lower holding space and slidably coupled between the adjacent legs with some of the drawers having a plurality of dividers arranged in sequence therein thereby creating a plurality of computer disk holding spaces; a rigid frame having a generally horizontal top wall offset above the table top and a pair of opposed spaced side walls each extended downwards and outwards at an angle from the top wall and coupled with the table top and thereby creating an upper holding space; and a plurality of shelves secured within the upper holding space and thereby creating a plurality of storage compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
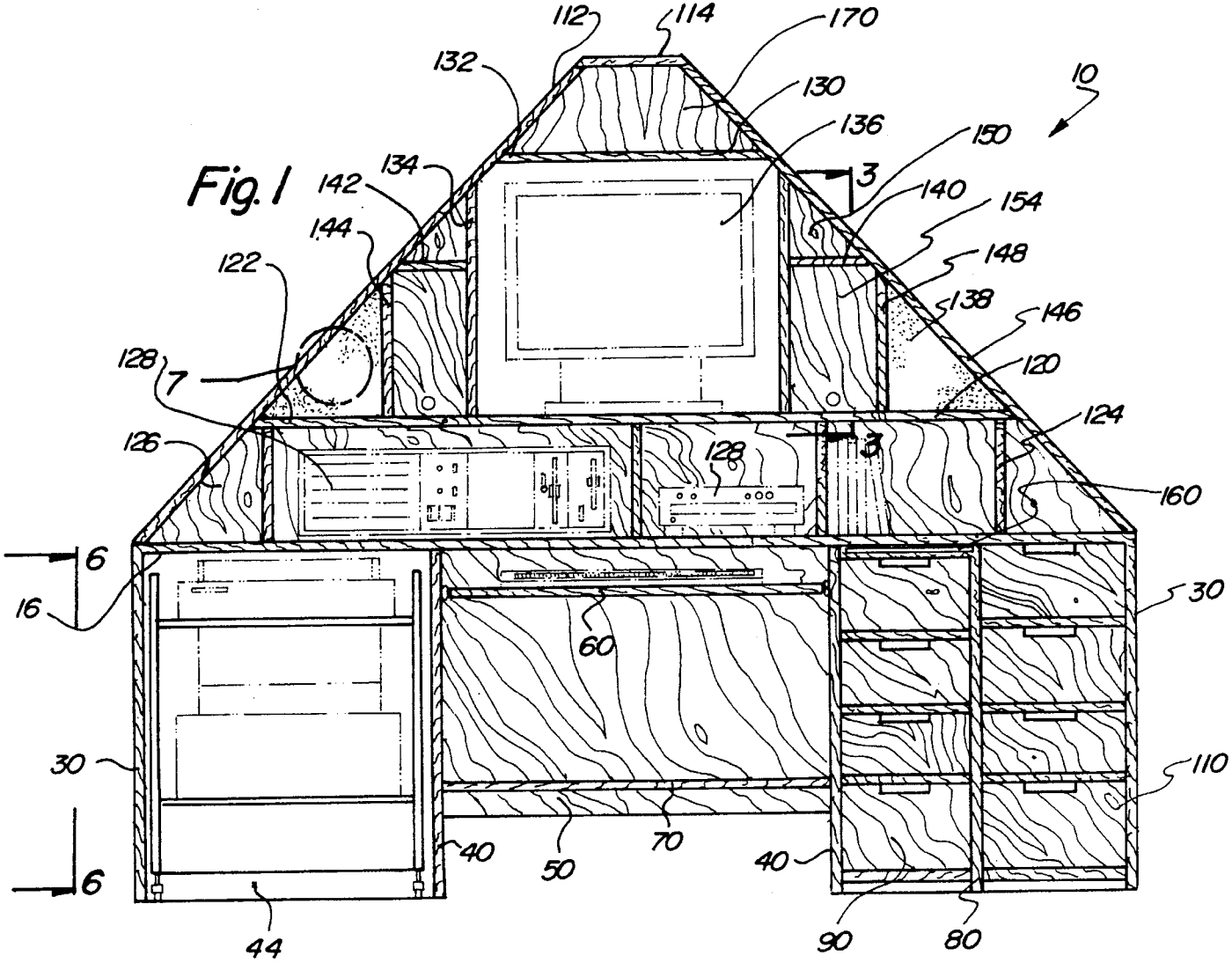
FIG. 1 is a side-elevational view of the preferred embodiment constructed in accordance with the principles of the present invention.
Figure 2:
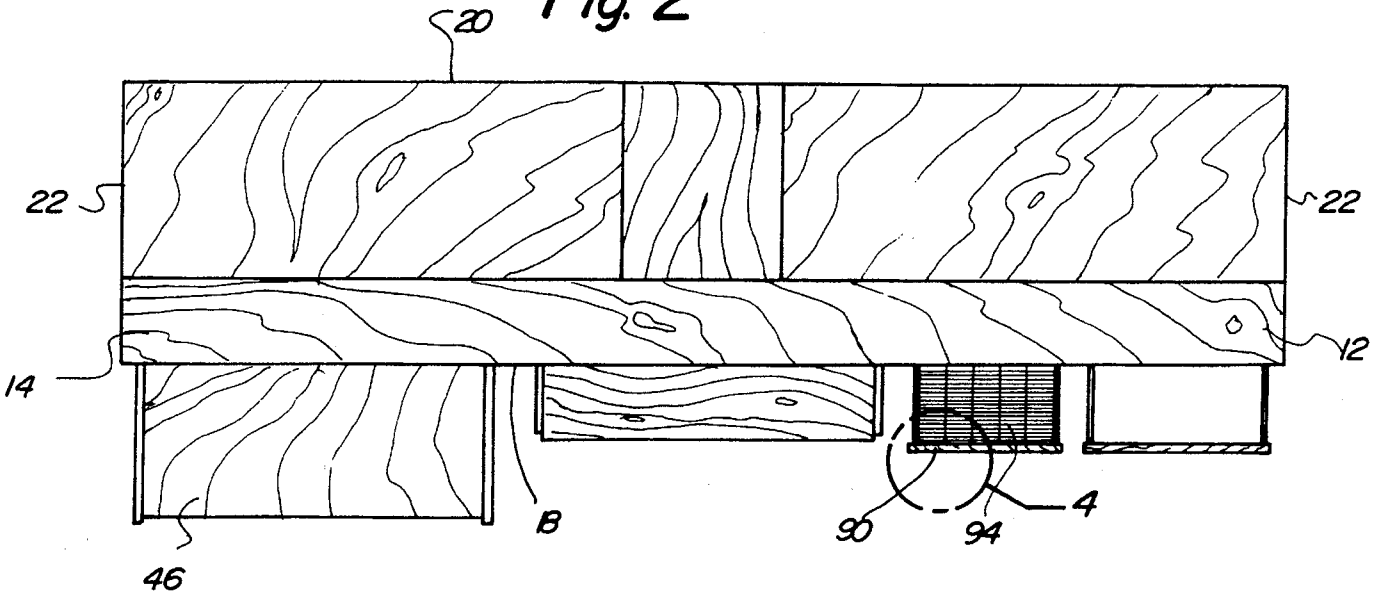
FIG. 2 is a plan view of the present invention with its keyboard shelf and drawers opened and a printer stand extended from a holding space.
Figure 3:
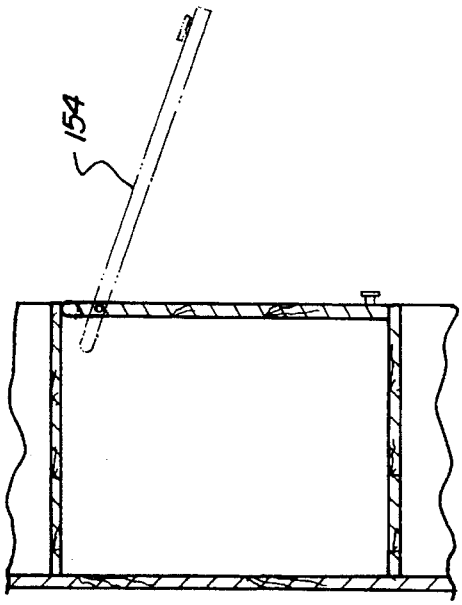
FIG. 3 is a cross-sectional view of the present invention taken along the line 3—3 of FIG. 1.
Figure 5:
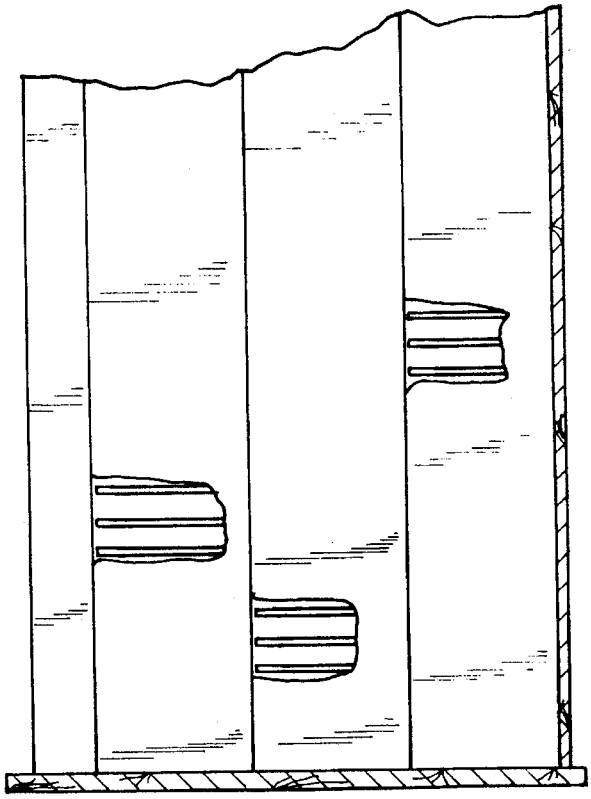
FIG. 5 is a side elevational view of a disk drawer with portions removed for depicting the dividers arranged in sequence.
Figure 4:
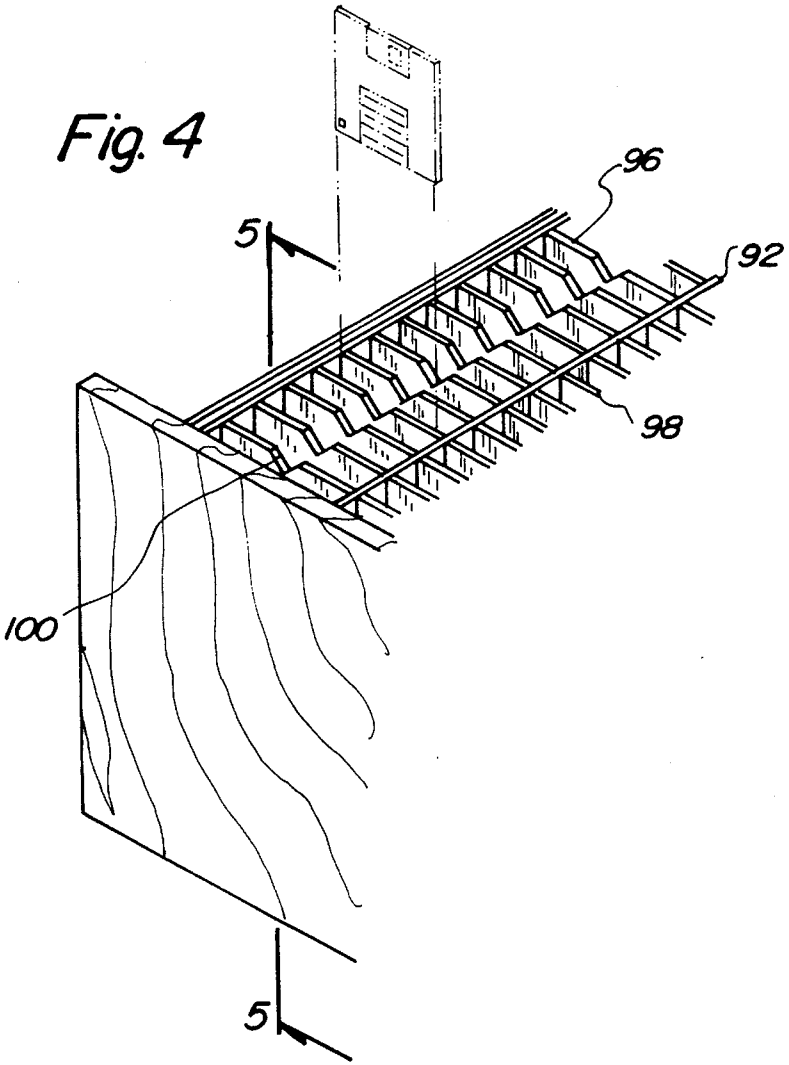
FIG. 4 is a perspective view of a disk drawer with a plurality of dividers disposed therein. Disks are positionable between the dividers.
Figure 7:
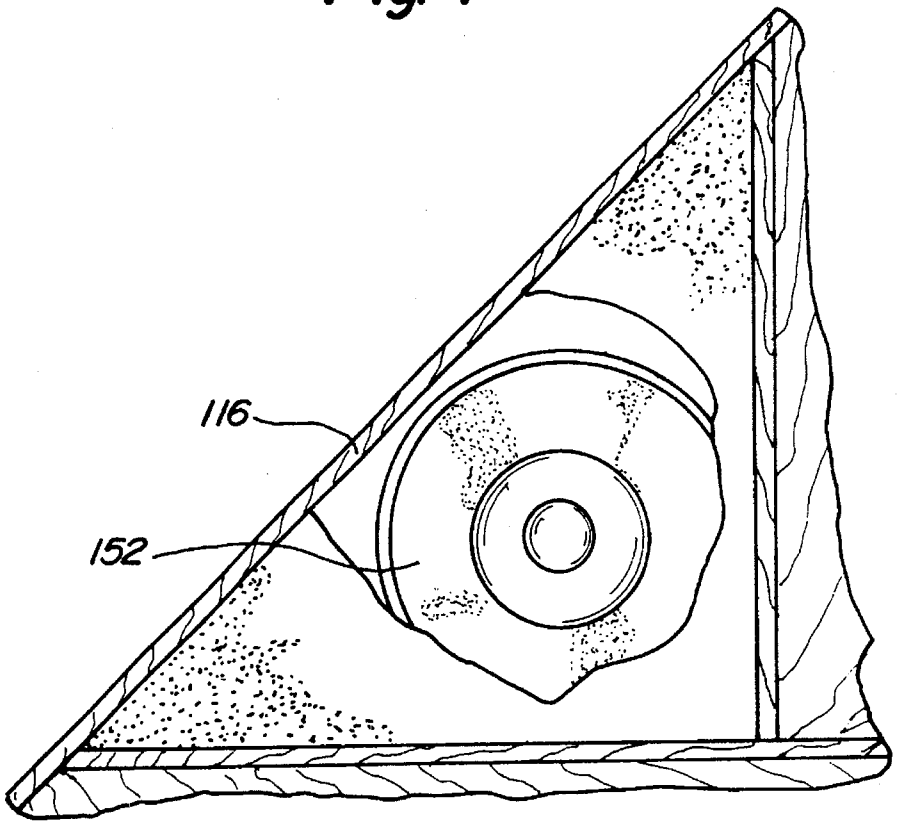
FIG. 7 is an enlarged side-elevational view of an outer intermediate storage compartment with a speaker secured therein.
Figure 6:
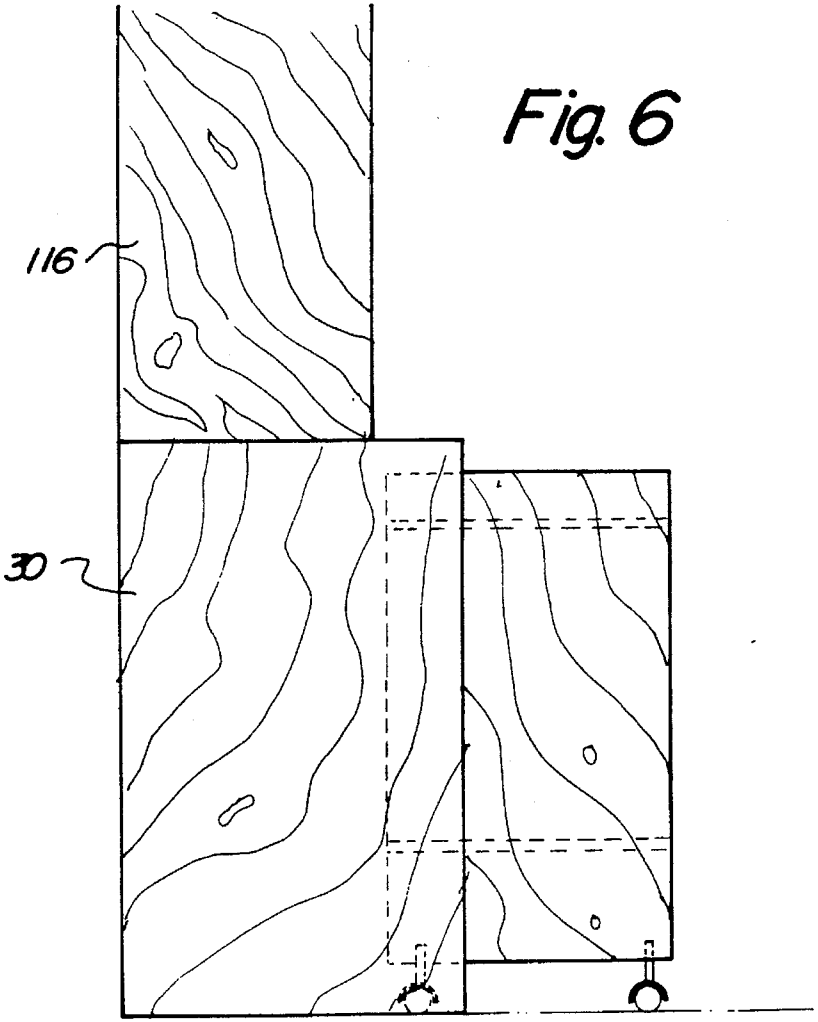
FIG. 6 is a side-elevational view of the present invention depicting the slidable positioning of a printer stand within one of the holding spaces.

With reference now to the drawings, and in particular, to FIG. 1 thereof, the preferred embodiment of the new and improved computer desk embodying the principles and concepts of the present invention and generally designated by the reference number 10 will be described.

Specifically, the present invention essentially includes sixteen major components. The major components are the table top, outer legs, inner legs, lower back wall, keyboard shelf, beam, intermediate leg, disk drawers, storage drawers, frame, lower shelf, upper inner shelf, upper outer shelves, doors, slide-out top, and upper back wall. These components are interrelated to provide the intended function.

More specifically, it will be noted in the various Figures that the first major component is the table top 12. The table top is rectangular and planar in structure and positioned horizontally. The table top is formed of a rigid material. The table top has a top surface 14 and a bottom surface 16. A periphery interconnects the top surface with the bottom surface. The periphery has a front edge 18, a rear edge 20, and opposed side edges 22 extended therebetween. The table top provides an extended working surface for a user.

The second major component is the outer legs 30. The present invention includes two outer legs. The outer legs are rectangular and planar in structure and positioned vertically. The outer legs are formed of a rigid material. The outer legs are spaced a distance away from each other. Each outer leg is coupled to a separate side edge 22 of the table top and extended downwards therefrom for contacting a recipient surface. The outer legs are used for supporting the table top.

The third major component is the inner legs. The present invention includes a pair of inner legs. The inner legs are rectangular and planar in structure and positioned vertically. The inner legs are formed of a rigid material. The inner legs are positioned spaced a distance away from each other. The inner legs are coupled to the bottom surface 16 of the table top at locations inwardly offset towards the center thereof. The inner legs then extend downwards from the table top for contacting a recipient surface. The extension of the inner legs and outer legs and their contact with the recipient surface create an inner holding space located between the inner legs and a pair of outer holding spaces each located between an inner leg 44 and an outer leg 30. One of the holding spaces is used for containing a printer stand 46 and associated printer and paper. The inner holding space is used for containing a user's legs therein for allowing him to work at the table top.

The fourth major component is the lower back wall 50. The lower back wall is rectangular and planar in structure and formed of a rigid material. The back wall is positioned vertically. The back wall is secured to the rear edge 20 of the table top and vertical edges of the legs 30, 40 therebelow. The lower back wall is used for providing extra rigidity and stability to the legs for holding the table top in a stable position.

The fifth major component is the keyboard shelf 60. The keyboard shelf is rectangular and planar in structure and formed of a rigid material. The keyboard shelf is positioned horizontally. The keyboard shelf is slidably coupled between the inner legs at a location offset below the table top. A plurality of guides secured to the inner legs may be used to perform the coupling function. The keyboard shelf may be extended for use in an operable orientation or retracted below the table top in a stowed configuration. The keyboard shelf is used for holding a computer keyboard thereon for typing.

The sixth major component is the beam 70. The beam is elongated in structure and formed of a rigid material. The beam is positioned horizontally. It is coupled between the inner legs 40 at a location offset below the keyboard shelf 60 and adjacent to the back wall 50. The beam is used for providing rigidity to the inner legs for supporting the table top.

The seventh major component is the intermediate leg 80. The intermediate leg is rectangular and planar and formed of a rigid material. It is positioned vertically. The intermediate leg is disposed in one of the outer holding spaces at a location between an inner leg 40 and an outer leg 30. The intermediate leg is coupled to the bottom surface 16 of the table top and extended downwards therefrom for contacting a supporting recipient surface. The intermediate leg in association with the adjacent inner leg and outer leg create an inner drawer space and an outer drawer space.

The eighth major component is the disk drawers 90. The present invention includes a plurality of stacked and rigid disk drawers. The disk drawers are disposed within the inner drawer space and slidably coupled between the inner leg 40 and intermediate leg 80. Each disk drawer has a plurality of longitudinally extended and vertically positioned rigid spacers 92 disposed therein. These spacers create an array of channels 94. Each disk drawer also includes a plurality of adjustable vertical rigid dividers 96 arranged in sequence within the channels and thereby creating a plurality of computer disk holding spaces 98. The spacers and dividers are formed to accommodate 5¼ inch computer disks and 3½ inch computer disks. Each divider further includes a notch 100 formed thereon for allowing easy access to computer disks placed in the disk holding spaces. Through the notch, the disks may also be browsed through readily.

The ninth major component is the storage drawers 110. The present invention includes a plurality of stacked storage drawers. The storage drawers are disposed within the outer drawer space. They are slidably coupled between the outer leg 30 and intermediate leg 80. The storage drawers are used for holding computer related equipment and supplies therein.

The tenth major component is the frame 112. The frame is formed of a rigid material. It has a horizontal rectangular planar top wall 114 centrally offset above the table top 12. It also includes a pair of rectangular planar side walls 116 coupled to the opposite edges of the top wall. Each side wall is extended downwards and outwards at an approximately 45° angle and coupled with a separate side edge 22 of the table top. This coupling with the table top thereby creates an upper holding space.

The eleventh major component is the lower shelf 120. The lower shelf is formed of a rigid material. It is disposed within the upper holding space above the table top 12. The lower shelf has a horizontal rectangular planar top 122 secured between the side walls of the frame. The lower shelf also includes four vertical spaced rectangular legs 124 extended downwards therefrom and coupled to the upper surface of the table top. This coupling thereby creates five lower storage compartments 126. These storage compartments are used for holding a variety of computer peripherals 128 therein such as a computer central processing unit, tape drive, compact disk player, modem, or facsimile machine. The three interior storage compartments essentially have a rectangular vertical cross-section. The two outer storage compartments each essentially have a triangular vertical cross-section.

The twelfth major component is the upper inner shelf 130. The upper inner shelf is rigid in structure. It is disposed within the upper holding space above the lower shelf 120. The upper inner shelf has a horizontal rectangular planar top 132 coupled between the side walls of the frame. It also includes two vertical spaced and rectangular inner legs 134 coupled between the side walls of the frame and the top of the lower shelf. This coupling thereby creates a central upper storage compartment and a central intermediate storage compartment. The central intermediate storage compartment is used for holding a computer monitor 136 therein. The central upper storage compartment has an essentially trapezoidal vertical cross section. The central intermediate storage compartment essentially has a rectangular vertical cross section.

The thirteenth major component is the upper outer shelves 140. The present invention includes a pair of upper outer shelves. The upper outer shelves are rigid in structure. They are disposed within the upper holding space on opposite sides of the central intermediate storage compartment. Each upper outer shelf has a horizontal rectangular planar top 142 coupled between a side wall 116 of the frame and an inner leg 134 of the upper inner shelf. Each upper outer shelf also includes a vertical outer leg 144 coupled to a side wall of the frame and the top 132 of the lower shelf. Each upper outer shelf thus creates an outer intermediate storage compartment 146, an inner intermediate storage compartment 148, and an upper intermediate storage compartment 150. The outer intermediate storage compartments each essentially have a triangular vertical cross-section. The inner intermediate storage compartments each essentially have a rectangular vertical cross-section. The upper intermediate storage compartments each have a triangular vertical cross section. The outer intermediate storage compartments are each adapted to hold a speaker 152 therein. These speakers may be coupled to a stereo or computer contained in one of the storage compartments.

The fourteenth major component is the doors 154. The present invention includes a pair of doors. Each door is extended over a separate inner intermediate storage compartment. Each door is hingeably secured to an inner leg 134 of the upper inner shelf and an outer leg 144 of the upper outer shelf. Each door is adapted to swing open in an upward direction. Each door also has a handle formed thereon for allowing a user a firm grip.

The fifteenth major component is the slide-out top 160. The slide-out top is coupled to the bottom surface of the table top above the disk drawers. The slid-out top may be extended in an operable configuration or retracted in a stowed configuration. The slide-out top allows an extension to the usable working surface available to a user.

The sixteenth major component is the upper back wall 170. The upper back wall is trapezoidal and planar in structure and formed of a rigid material. The upper back wall is positioned vertically. It is coupled across the side walls and top wall of the frame and planarly aligned with the back wall. The upper back wall provides rigidity to the frame and the associated shelves within the upper holding space. The upper back wall may be combined with the lower back wall in one integral unit for performing the supporting function.

Prior art computer desks provide a flat surface at normal desk height that the CPU (central processing unit) sits on and they usually have a slide out keyboard shelf upon which the keyboard rests. However, they provide no place for storing computer disks. Most people who use personal computers soon wind up with a lot of diskettes which store their programs, data, games, and their backup copies, and they have no convenient place to store them near the computer that doesn't require the use of the working surface of the desk. The present invention is an improvement on computer desks that not only provides enough space in an ergonomic arrangement but also solves the problem of organizing and storing a large number of diskettes in a small space and making them readily available for use.

This desk is similar to large computer desks but has a unique pyramidal shaped hutch for storing items in an easy-to-use arrangement and has four special drawers for storing diskettes. It could be made of pressed wood with simulated wood plastic veneer, with metal fastenings, hinges, drawer handles, and slides. The left side of the desk is hollow to contain a roll-out or slide-out printer stand. The right side contains two sets of drawers, side by side. The left side contains a number of diskette storage drawers. These have slotted wood dividers on their bottoms to store diskettes. A slide-out table top is secured above the drawers on the left side.

The hutch, formed of the frame and shelves in the upper holding space, has two sides angled at 45° and a flat top. The lower shelf is positioned above the desk top. Vertical legs are located at both ends, in the center, and midway between the center and right side. These provide space for the CPU on the left and other peripheral devices and/or books on the right. The space for the monitor is a square. There are two storage compartments with doors on either side of the space for holding the monitor. The remaining three triangular storage spaces on each side and the trapezoidal space at the top are open for storing small items or for speakers. A sliding keyboard shelf is located in the center section and is fastened to the desk on each side by ball bearing slides.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A computer desk comprising:

a generally horizontal table top;

a plurality of spaced legs extended downwards from the table top for contacting a recipient surface therebelow and thereby creating a plurality of lower holding spaces;

a generally horizontal keyboard shelf extendably secured below the table top;

a plurality of stacked drawers disposed within at least one lower holding space and slidably coupled between the adjacent legs with some of the drawers having a plurality of dividers arranged in sequence therein thereby creating a plurality of computer disk holding spaces;

a rigid frame having a generally horizontal top wall offset above the table top and a pair of opposed spaced side walls each extended downwards and outwards at an angle from the top wall and coupled with the table top and thereby creating an upper holding space; and a plurality of shelves secured within the upper holding space and thereby creating a plurality of storage compartments.

2. The computer desk as set forth in claim 1 further including a slide-out top secured below the table top.

3. The computer desk as set forth in claim 1 further including a generally vertical back wall extended across the frame and legs and coupled thereto.

4. The computer desk as set forth in claim 1 further including a plurality of beams coupled between the legs.

5. The computer desk as set forth in claim 1 further including a plurality of doors with each door extended over a separate storage compartment.

6. A computer desk for supporting computer-related equipment and holding computer disks therein comprising, in combination:

a horizontal rectangular rigid planar table top having a top surface and a bottom surface and a periphery interconnecting the top surface with the bottom surface having a front edge, rear edge, and opposed side edges extended therebetween;

two parallel spaced vertical rectangular rigid planar outer legs with each outer leg coupled to a separate side edge of the table top and extended downwards therefrom for contacting a recipient surface;

two parallel spaced vertical rectangular rigid planar inner legs, the inner legs coupled to the bottom surface of the table top at locations inwardly offset towards the center thereof, the inner legs extended downwards therefrom for contacting a recipient surface and thereby creating an inner holding space located between the inner legs and a pair of outer holding spaces each located between an inner leg and an outer leg;

a vertical rectangular rigid planar lower back wall secured to the rear edge of the table top and vertical edges of the legs therebelow;

a horizontal rectangular rigid planar keyboard shelf slidably coupled between the inner legs at a location offset below the table top;

a horizontal rigid beam coupled between the inner legs at a location offset below the keyboard shelf and adjacent to the lower back wall;

a vertical rectangular rigid planar intermediate leg disposed within one of the outer holding spaces at a location between an inner leg and an outer leg, coupled to the bottom surface of the table top, and extended downwards therefrom for contacting a recipient surface and thereby creating an inner drawer space and an outer drawer space;

a plurality of stacked disk drawers disposed within the inner drawer space and slidably coupled between the inner leg and intermediate leg, each disk drawer having a plurality of longitudinally positioned vertical rigid spacers disposed therein creating an array of channels and a plurality of adjustable vertical rigid dividers arranged in sequence within the channels and thereby creating a plurality of computer disk holding spaces, each divider further having a notch formed thereon for allowing easy access within a computer disk holding space;

a plurality of stacked storage drawers disposed within the outer drawer space and slidably coupled between the outer leg and intermediate leg;

a rigid frame having a horizontal rectangular rigid planar top wall centrally offset above the table top and a pair of rectangular planar side walls coupled to opposite edges of the top wall and each extended downwards and outwards at an angle and coupled with a separate side edge of the table top thereby creating an upper holding space;

a rigid lower shelf disposed within the upper holding space above the table top, the lower shelf having a horizontal rectangular planar top secured between the side walls of the frame and four vertical spaced rectangular legs extended downwards therefrom and coupled to the upper surface of the table top thereby creating five lower storage compartments;

a rigid upper inner shelf disposed within the upper holding space above the lower shelf, the upper inner shelf having a horizontal rectangular planar top coupled between the side walls of the frame and two vertical spaced rectangular inner legs coupled between the side walls of the frame and the top of the lower shelf thereby creating a central upper storage compartment and a central intermediate storage compartment;

a pair of rigid upper outer shelves disposed within the upper holding space on opposite sides of the central intermediate storage compartment, each upper outer shelf having a horizontal rectangular planar top coupled between a side wall of the frame and an inner leg of the upper inner shelf and a vertical outer leg coupled to a side wall of the frame and the top of the lower shelf and each thereby creating an outer intermediate storage compartment, an inner intermediate storage compartment, and an upper intermediate storage compartment;

a pair of doors with each door extended over a separate inner intermediate storage compartment and hingeably secured to an inner leg of the upper inner shelf and an outer leg of the upper outer shelf;

a horizontal rectangular rigid slide-out top coupled to the bottom surface of the table top above the disk drawers; and a vertical trapezoidal planar rigid upper back wall coupled across the side walls and top wall of the frame and planarly aligned with the lower back wall.

* * * * *